US006029757A

United States Patent [19]

Anderson et al.

[11] Patent Number: 6,029,757

[45] Date of Patent: Feb. 29, 2000

[54] CASING HAMMER ASSEMBLY FOR CABLE TOOL DRILLING APPARATUS

[76] Inventors: Vaughn J. Anderson; Kenneth W. J. Anderson, both of RR#2, Site 225, C5, Courtenay, British Columbia, Canada, V9N 5M9

[21] Appl. No.: 08/985,071

[22] Filed: Dec. 4, 1997

[51] Int. Cl.[7] ..... E21B 1/00

[52] U.S. Cl. ..... 175/171; 175/135; 173/202

[58] Field of Search ..... 175/22, 23, 135, 175/171, 237, 161; 173/202, 203, 89

[56] References Cited

U.S. PATENT DOCUMENTS

| | | | |
|---|---|---|---|
| 3,685,596 | 8/1972 | Collins | 175/57 |
| 4,232,752 | 11/1980 | Hauk et al. | 175/135 |
| 4,652,195 | 3/1987 | McArthur | 175/161 |
| 4,669,552 | 6/1987 | Foster et al. | 173/117 |
| 4,732,220 | 3/1988 | Johnsson | 173/202 |
| 5,310,014 | 5/1994 | Mueller | 175/171 |
| 5,375,667 | 12/1994 | Trevisani | 175/52 |
| 5,549,170 | 8/1996 | Barrow | 175/55 |

*Primary Examiner*—William Neuder
*Assistant Examiner*—John Kreck
*Attorney, Agent, or Firm*—Lee, Mann, Smith, McWilliams, Sweeney & Ohlson

[57] ABSTRACT

A casing hammer assembly for a cable tool drilling apparatus and a cable tool drilling apparatus employing the casing hammer assembly. The casing hammer assembly includes a hammer housing which is positioned on a casing pipe and having a central aperture for through passage of a cable tool drilling string. An impact anvil is located in the housing, surrounding the central aperture, and a reciprocal hammer is mounted for striking the anvil. An eccentric arrangement is employed for raising the hammer for repeated striking of the anvil in order to sink the casing pipe. A hydraulic arm is utilized for laterally positioning the hammer housing in relation to the casing pipe.

19 Claims, 8 Drawing Sheets

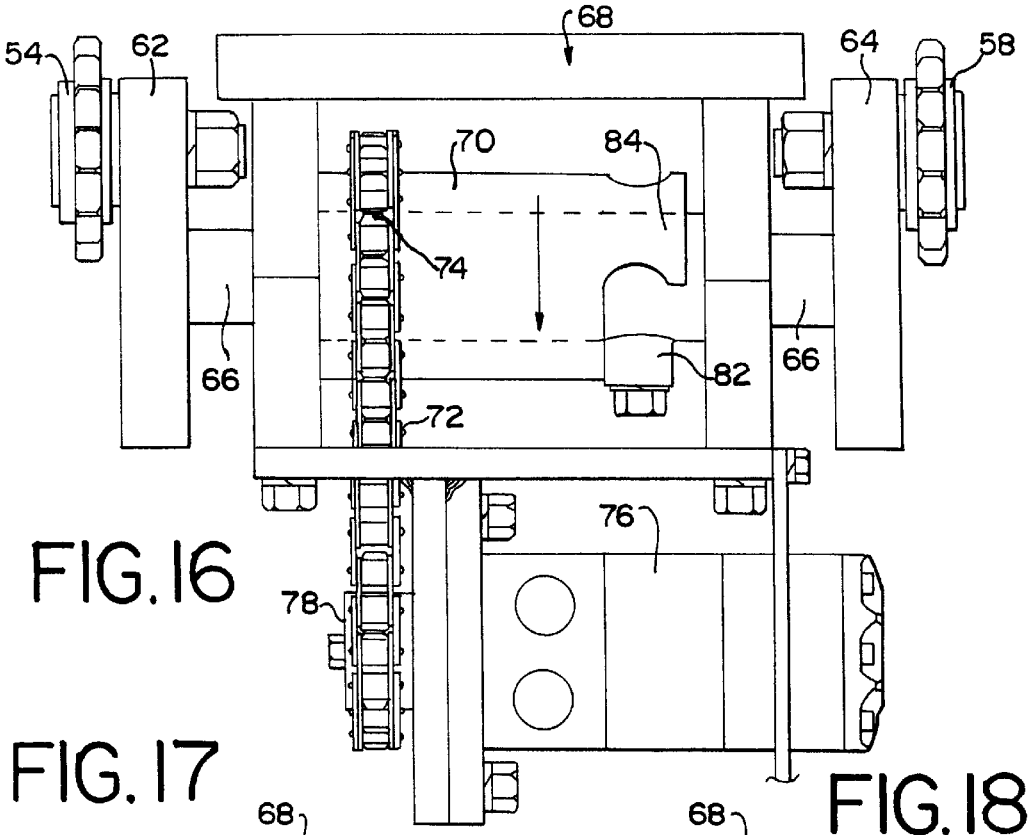
FIG. 16
FIG. 17
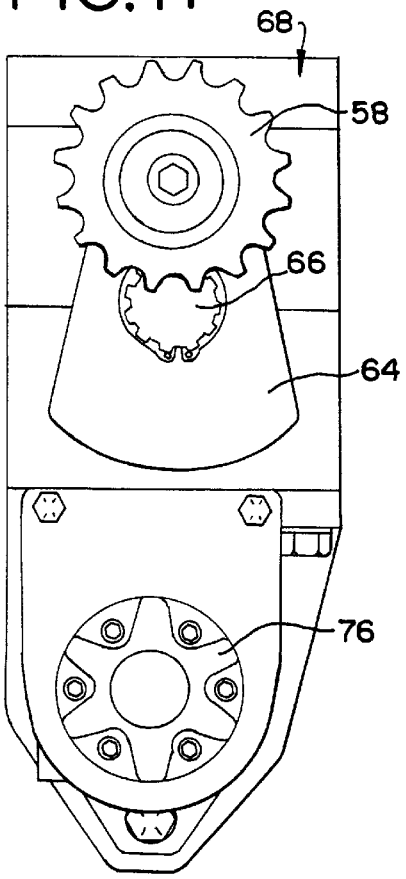
FIG. 18
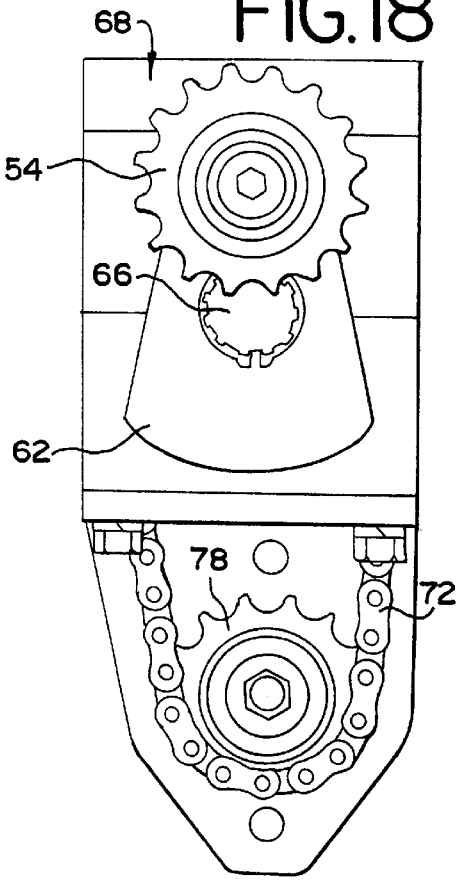

CASING HAMMER ASSEMBLY FOR CABLE TOOL DRILLING APPARATUS

BACKGROUND OF THE INVENTION

This invention relates to well drilling equipment, and in particular to cable tool drilling apparatus. The invention involves a casing hammer assembly for a cable tool drilling apparatus, as well as related equipment and the cable tool drilling apparatus itself.

Cable tool drilling apparatus is well known. Typical cable tool drilling involves utilization of an impact drilling string extending through a length of casing pipe. After the impact operations have proceeded for a while, the drilling string is withdrawn from the casing pipe and a heavy annular hammer is clamped to the drill stem. The drill stem is then returned to the casing pipe, and the impact operation resumes with the annular hammer then being repeatedly raised and released as in the drilling phase to drive the casing pipe farther into the ground. Once the casing pipe has been driven to a desired further depth, the drilling string is again raised, the annular hammer is removed, and the impact drilling operation resumes. This process is then repeated many dozens of times in order to sink a well of a desired depth.

As can be appreciated from the nature of this kind of an operation, the impact drilling must be interrupted many times in order to drive the casing further into the ground. In fact, most of the time spent "drilling" is actually spent running the drilling apparatus into and out of the bore hole, not in the actual drilling process itself.

A further disadvantage of impact drilling is the fact that the drill bit is often well down the bore hole from the end of the casing pipe. The drilling operation then often causes excessive amounts of loose materials to cave into the bore hole, thereby requiring additional time and effort to remove the excessive amount of material that accumulates. Also, water is a necessary lubricant used in the drilling process, and often it is necessary for an operator to climb up the drilling mast in order to access the top of the casing pipe in order to inject water, therefore also consuming additional time as well as wear and tear on the operator.

In order to eliminate the constant shifting between impact drilling and sinking of the casing pipe, other apparatus has been developed to make the drilling process a more continuous operation. For example, U.S. Pat. No. 5,310,014 discloses a cable tool drilling apparatus which includes a separate driving ram which allows the drilling string to be passed through the ram and permits the ram to be utilized at the same time that the impact drilling process proceeds. While a significant improvement over the prior intermittent drilling operation, the apparatus of this patent has its own disadvantages. First, the ram is relatively long and must fit over the casing pipe. Thus, a different size of ram must be employed for every different diameter of casing pipe. Also, because of the relatively long length of the ram, the final casing pipe cannot be driven close the ground and must be cut at an acceptable height above the ground. In addition, because the ram is constantly driven up and down axially in relation to the casing pipe, there is the potential for damage of the pipe during the hammering operation, unless the ram is held fairly precisely in relation to the casing pipe. Also, in order to move the ram out of alignment with the casing pipe, it must be lifted to a significant height, and then shifted in some manner, such as by swinging the entire derrick assembly to one side or the other, a time consuming process.

SUMMARY OF THE INVENTION

The invention relates to an improved casing hammer assembly for a cable tool drilling apparatus, and the resulting cable tool drilling apparatus. The casing hammer assembly includes an upstanding hammer housing with means for mounting the hammer housing on a casing pipe. A central aperture is provided through the hammer housing with the aperture being formed to permit drilling apparatus to pass freely through the hammer housing into and out of the casing pipe upon which the hammer housing is mounted. A guide is provided proximate and at least partially surrounding the central aperture, and an impact anvil is provided, surrounding the guide and secured to the hammer housing. A reciprocal hammer is mounted on the guide in the housing and is positioned to strike the impact anvil. Means is provided for actuating the hammer, this means comprising an eccentric which is connected for periodically raising and releasing the hammer, and a motor for driving the eccentric.

In accordance with the preferred form of the invention, also included is means for laterally shifting the hammer housing in relation to the casing pipe. The means for lateral shifting comprises a retractable arm which is fixed above the hammer housing. The retractable arm comprises a first stationary member and a second movable member which is secured to the stationary member. The movable member is pivotally secured at one end to the stationary member, and a hydraulic cylinder connected to the members is provided for actuating the movable member.

In the preferred form of the invention, the guide surrounding the central aperture preferably comprises a central tube. The tube extends from top to bottom in the hammer housing, and is sufficiently large to allow the drilling apparatus to pass freely through the hammer housing.

The invention includes means biasing the hammer toward the impact anvil. In accordance with the preferred form of the invention, the biasing means comprises at least one compression spring which bears between the hammer housing and the hammer. The spring is mounted to accentuate the driving force of the hammer against the anvil.

In accordance with the invention, the eccentric comprises a rotatable shaft having an offset hammer operator at one end. A sleeve is freely mounted on the shaft for revolving relative to the shaft, and the shaft includes a radially protruding lug. The sleeve includes an extension shaped to engage the lug in order to rotate the shaft in unison with the sleeve when the extension engages the lug. The motor is drivingly connected to the sleeve for rotating the sleeve, preferably by an endless chain drive.

A flexible support is provided in the hammer housing above the anvil, with the hammer operator engaging the flexible support. Preferably the flexible support comprises a chain which is secured between the hammer housing and the hammer, and the hammer operator comprises a gear wheel mounted on an arm which extends radially from one end of the rotatable shaft. A pair of the chains and a pair of the gear wheels, on opposite ends of the rotatable shaft, are preferred for proper driving of the hammer. The motor, which may be conventional, is preferably a hydraulic motor.

The means for mounting the hammer housing on a casing pipe preferably comprises a collar extending from the impact anvil. The collar is formed so that a single apparatus can be utilized to drive various diameters of casing pipes without being changed.

Means is also provided for positioning and holding the hammer housing above the casing pipe. In accordance with the preferred form of the invention, the means for positioning and holding comprises cable pulleys mounted atop the hammer housing adjacent to the central aperture, with a hoist cable engaged in the pulleys. The hoist cable extends to the derrick in a conventional fashion.

For ease of water injection, the invention also includes a water injection port on the hammer housing, the port leading to the central tube.

The apparatus according to the invention forms part of a cable tool drilling apparatus, being suspended from a portable derrick which is used in a generally conventional fashion. The drilling string extends from the derrick on one cable, and the hammer housing is suspended from the derrick on a second cable. The retractable arm is suspended from the derrick above the greatest extent of vertical travel of the hammer housing and is positioned to engage both cables in order to shift both the hammer housing and the drilling string laterally in order to provide easy access by the operator to the casing pipe.

BRIEF DESCRIPTION OF THE DRAWINGS

The invention is described in greater detail in the following description of an example embodying the best mode of the invention, taken in conjunction with the drawing figures, in which:

FIG. 16 is a greatly enlarged view of the portions of the apparatus utilized in the hammer housing to raise and release the impact hammer, FIG. 17 is a side elevational view of the apparatus illustrated in FIG. 16, looking from the right side of FIG. 16, and FIG. 18 is a similar illustration, but taken looking from the left side of FIG. 16.

DESCRIPTION OF AN EXAMPLE EMBODYING THE BEST MODE OF THE INVENTION

Figure 1:
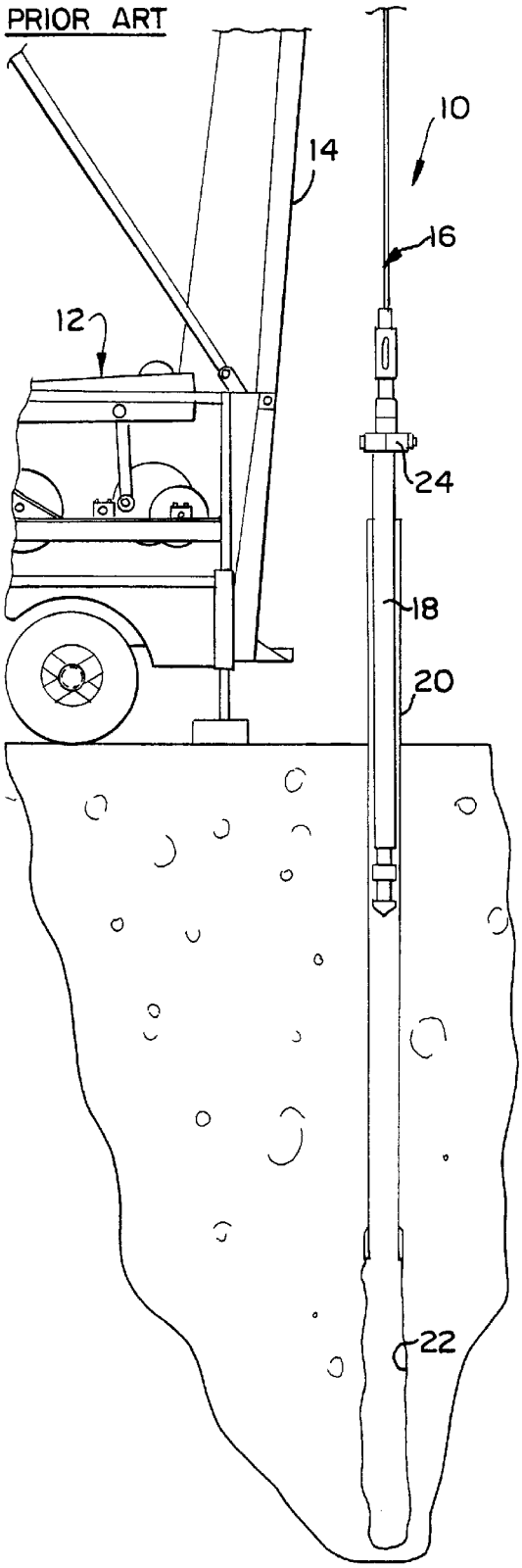
FIG. 1 PRIOR ART
FIG. 1 illustrates a prior art cable tool drilling apparatus prior to the improvements of the present invention.

Turning first to FIG. 1, illustrated is a prior art cable tool drilling apparatus which has been improved by that illustrated and described in relation to FIGS. 2 through 18. The prior art cable tool drilling apparatus is designated generally at 10, and includes a truck 12 or other appropriate vehicle having an extendible vertical derrick 14 from which a drilling string 16 is suspended for impact drilling purposes. The drilling string 16 includes a drill stem 18 which extends into the casing pipe 20 of a partially drilled well.

The illustration in FIG. 1 depicts the typical point in the drilling operation where the well has been drilled a desired distance beneath the end of the casing pipe 20, leaving a relatively long unprotected hole 22. As illustrated, it is common that the sides of the hole 22 cave into the hole during the drilling operation, requiring a tremendous amount of additional material to be withdrawn during the drilling operation than would be necessary to simply accommodate the casing pipe 20.

As illustrated in FIG. 1, in order to drive the casing pipe 20 in the prior art apparatus, the drilling string 20 is withdrawn from the hole 22 sufficiently to expose a portion of the drill stem 18. At this point, a hammer assembly 24 is clamped to the drill stem 18, and then reciprocating operation of the cable tool drilling apparatus impacts the hammer assembly 24 on the casing pipe 20, driving the casing pipe 20 into the ground. Then, the hammer assembly 24 must be removed for the drilling process to continue. This start/stop operation is repeated dozens of times for each length of casing pipe 20 as it is sunk into the ground, leading to a long, involved and arduous process to drill a well using the prior art apparatus 10.

Figure 2:
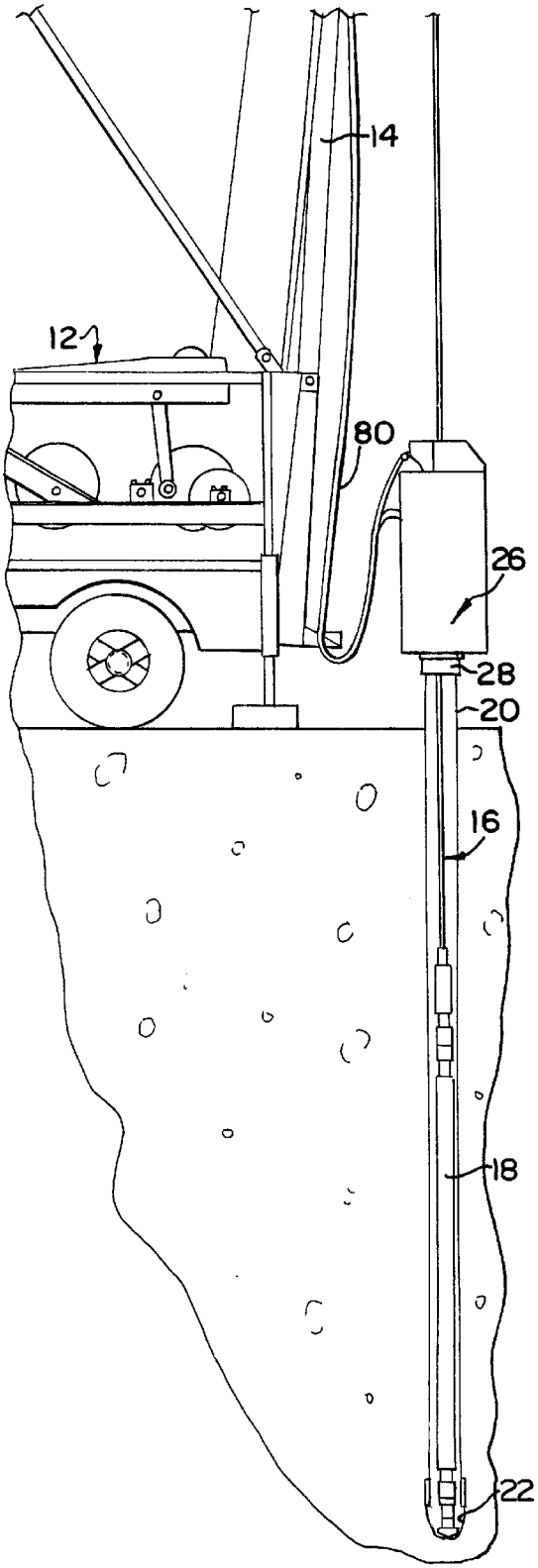
FIG. 2 is a side elevational illustration of utilization of the invention to sink a casing pipe while the cable tool drilling process proceeds.

FIG. 2 is view similar to FIG. 1, but illustrating utilization of the improvements of the present invention. Parts that remain the same as the prior art cable tool drilling apparatus 10 of FIG. 1 bear the same reference numerals.

In accordance with the invention, a casing hammer assembly is provided, including an upstanding hammer housing 26. The hammer housing 26 includes an extending collar 28 for mounting the hammer housing 26 on the casing pipe 20. As best illustrated in FIGS. 9 through 15, the collar 28 is shaped to accommodate varying sizes of casing pipes. Therefore, as illustrated, the collar 28 has a flared shape to fit within large diameter casing pipes, and can also be formed internally (not illustrated) so that smaller casing pipe, such as the casing pipe 20 illustrated in FIG. 2, fits within the collar 20.

The hammer housing 26 employs appropriate external shields 30 through 36 to protect the operating elements of the casing hammer assembly of the invention. The shields 30 through 36 are removed in FIGS. 11 through 15 so that the internal elements of the hammer housing 26 are exposed.

The hammer housing 26 includes a central aperture which is surrounded by a guide in the form of a central tube 38 extending from top to bottom in the hammer housing 26. As illustrated, the central tube 38, which is cylindrical, forms the central aperture and permits the drilling string 16 to freely pass through the hammer housing 26 into and out of the casing pipe 20.

An impact anvil 40 surrounds the central tube 38 and is bolted to the hammer housing 26. The collar 28 extends from, and forms part of, the impact anvil 40.

A reciprocal hammer 42 is mounted on the central tube 38 and is positioned to repeatedly strike the impact anvil 40 for sinking of a casing pipe 20 into the ground. The reciprocal hammer 42 is normally at rest against the impact anvil 40, and is biased in that orientation by a compression spring 44 which bears between the hammer housing 26 and the top of the reciprocal hammer 42.

An eccentric is utilized in order to raise the hammer 42 and then release it for impact against the anvil 40 (and therefore the casing pipe 20 upon which the hammer housing 26 is mounted). The eccentric is composed of identical mechanisms employing a pair of chains 46 and 48 on opposite sides of the central tube 38. Each of the chains 46 and 47 is secured to a respective bracket 50 and 52 mounted in the hammer housing 26. The brackets 50 and 52 can employ appropriate cushioning to absorb impact received through the respective chains 46 and 48 as the hammer 42 is operated. The chain 46 passes from the bracket 50 over a first gearwheel or sprocket 54 and then over a second sprocket 56 and is appropriately secured to the top of the hammer 42. Similarly, the chain 48 extends from the bracket 52 over a first gearwheel or sprocket 58 and then over a second gearwheel or sprocket 60 to a fixed attachment atop the hammer 42.

The sprockets 56 and 60 are appropriately secured for rotation in place to the hammer housing 26. The sprockets 54 and 58, however, are, as best illustrated in FIGS. 16 through 18, mounted on a respective arm 62 and 64 extending radially from opposite ends of a rotatable shaft 66. The shaft 66 is mounted for rotation in a bracket assembly 68 secured to the top of the hammer housing 26. The shaft 66 also passes through a sleeve 70 which is freely mounted on the shaft 66 for revolving relative to the shaft. The sleeve 70 is driven, in turn, by a chain 72 engaged on a gearwheel 74 formed on the sleeve 70, the chain 72 being driven by a hydraulic motor 76 which drives a sprocket 78 over which the chain 72 passes. The motor 76 is operated hydraulically by means of hydraulic fluid provided through hoses 80 from a hydraulic source on the truck 12 (the source not being shown in detail). The motor 76 can be driven in a conventional fashion, and is therefore not further described.

A lug 82 protrudes radially from the shaft 66. The lug 82 is engaged by a small extension 84 of the sleeve 70. By "small", it is meant that the extension 84 extends for only a portion of the circumference of the sleeve 70, an appropriate amount to be sufficiently strong, but less than 180° and preferably on the order of about 90° or less, the reason for which will become apparent below when the operation of the reciprocal hammer 42 is explained.

Figure 3:
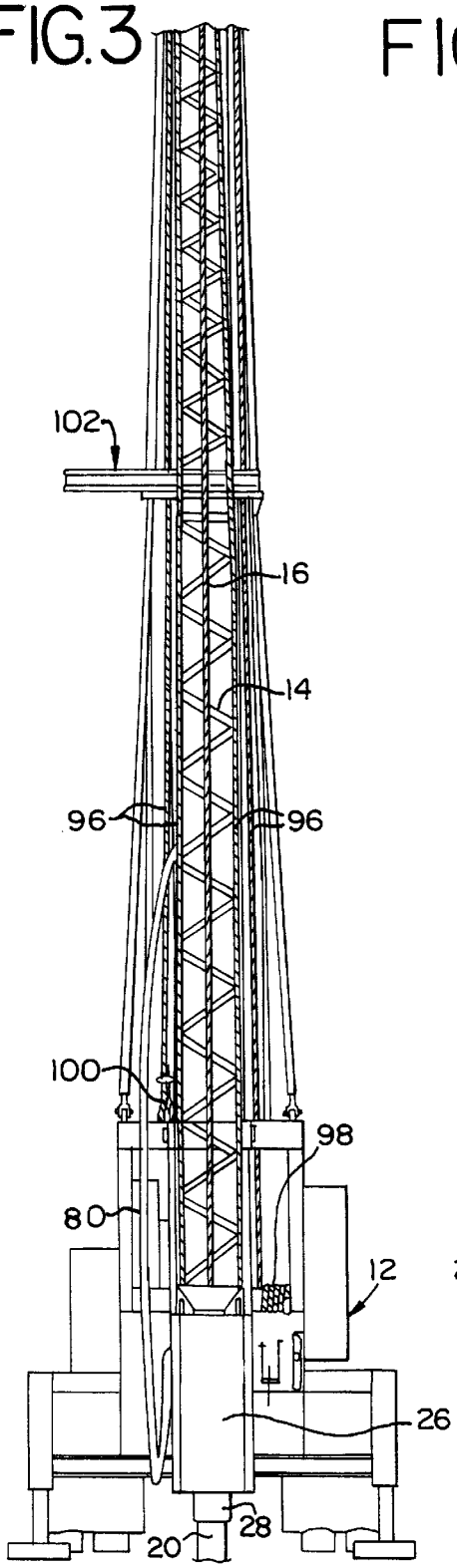
FIG. 3 is a rear elevational illustration of the invention, with the hammer housing positioned on the casing pipe.

An annular guide 86 is mounted atop the hammer housing 26, the guide 86 being flared as illustrated. The guide 86 includes an outlet 88 in axially registration with the central tube 38 and is flared in order to aid feeding of the drill string 16 into and through the hammer housing 26. Three cable pulleys 90, 92 and 94 are mounted on the guide 86 as illustrated, and a cable 96 is threaded through the cable pulleys 90 through 94 and extends upwardly through appropriate pulleys on the top of the derrick 14, one end of the cable 96 being wrapped on a drum 98 on the truck 12 (FIG. 3), and the other end of the cable 96 being fixed to the derrick at 100 (FIG. 3). Thus, by operation of the drum 98 in a conventional fashion, the hammer housing can be raised or lowered as desired for placement on the casing 20.

Figure 4:
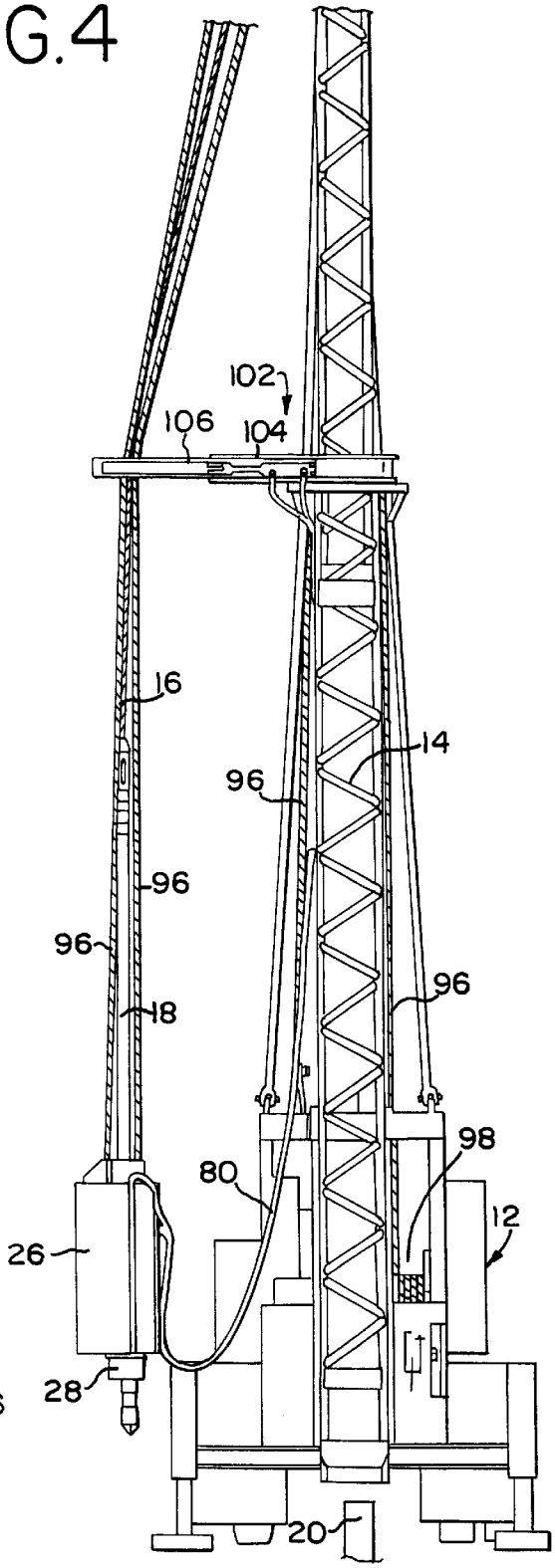
FIG. 4 is a view similar to FIG. 3, but with the hammer housing and drilling string shifted laterally by the retractable arm.
Figure 5:
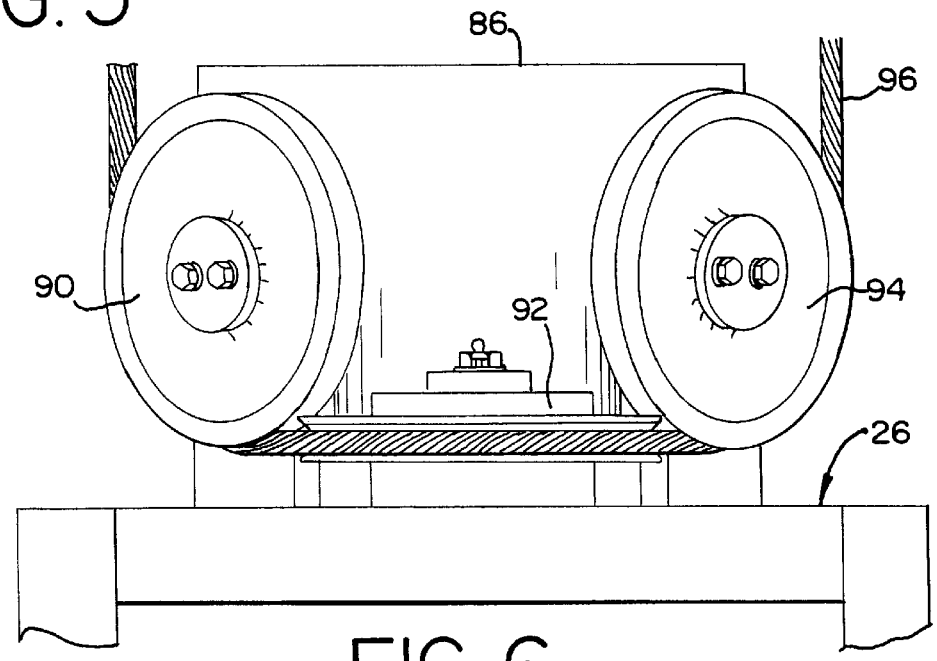
FIG. 5 is an enlarged elevational view of the top of the hammer housing, illustrating the pulley arrangement for positioning of the hammer housing.
Figure 6:
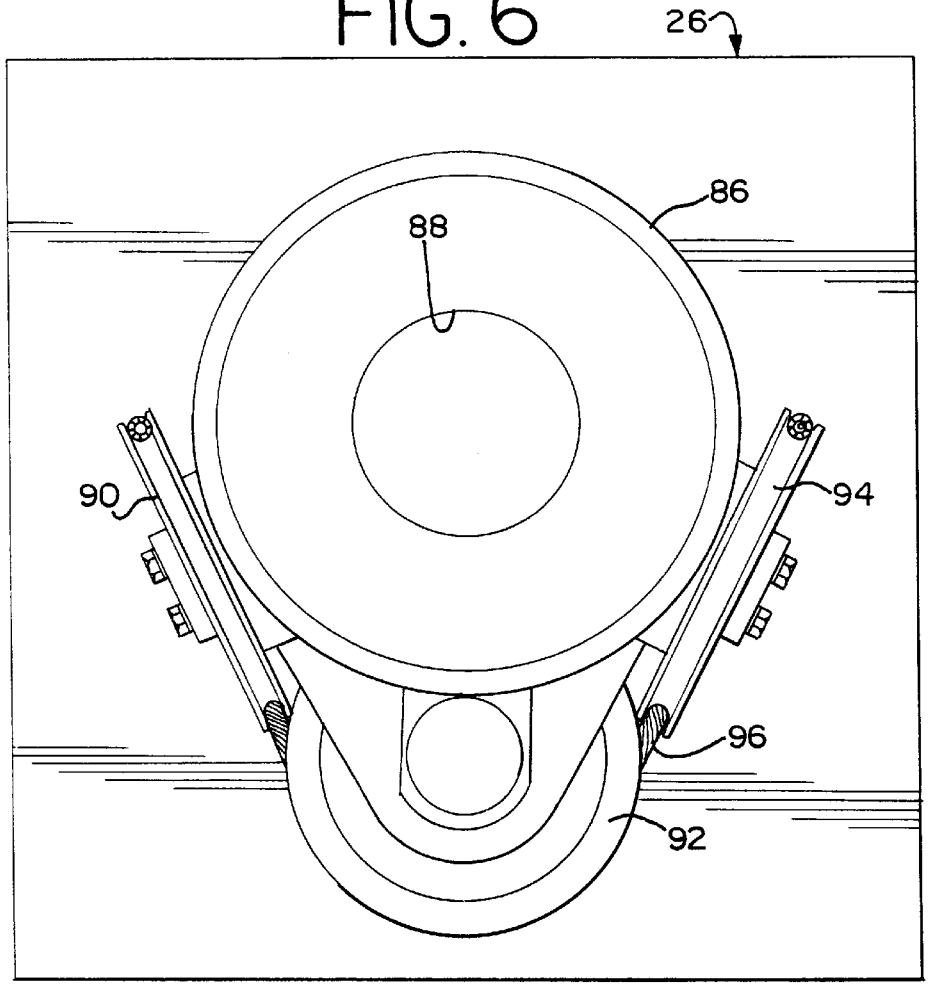
FIG. 6 is a top plan view of the apparatus illustrated in FIG. 5.
Figure 8:
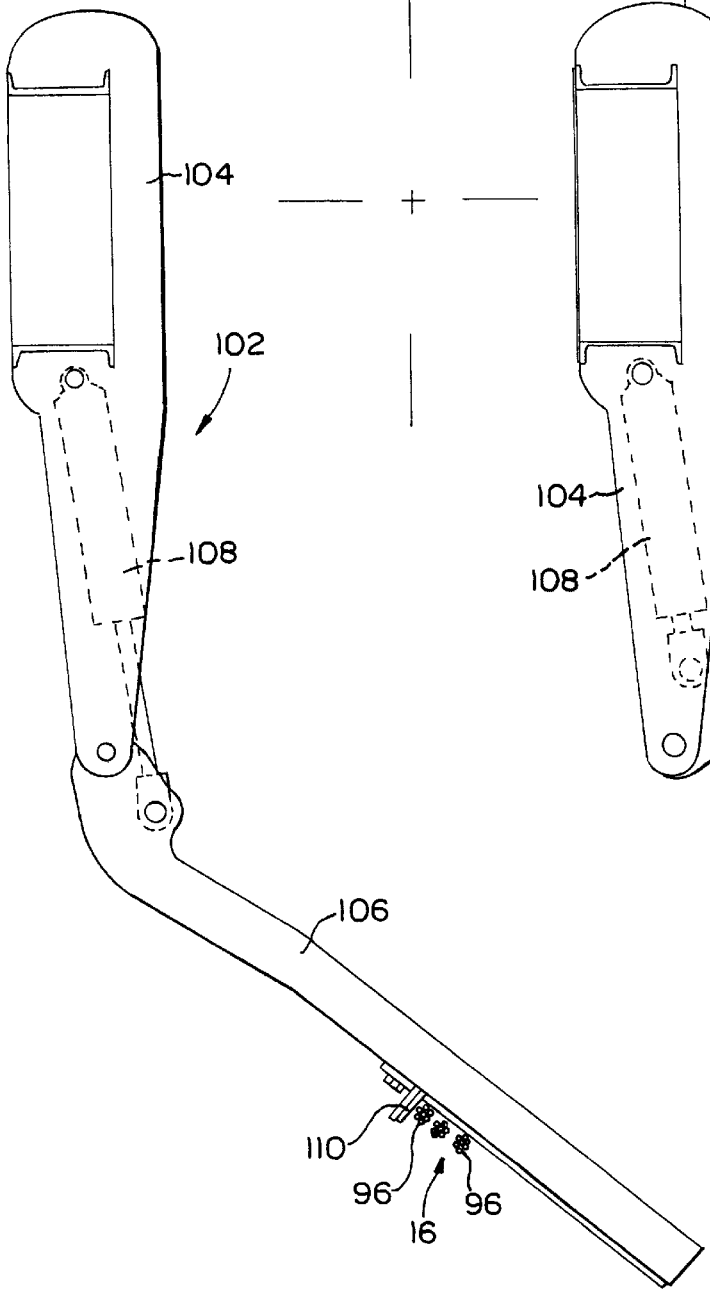
FIG. 8 is a view similar to FIG. 7, but with the retractable arm extended to laterally shift the cables and therefore the hammer housing and the drilling string.
Figure 7:
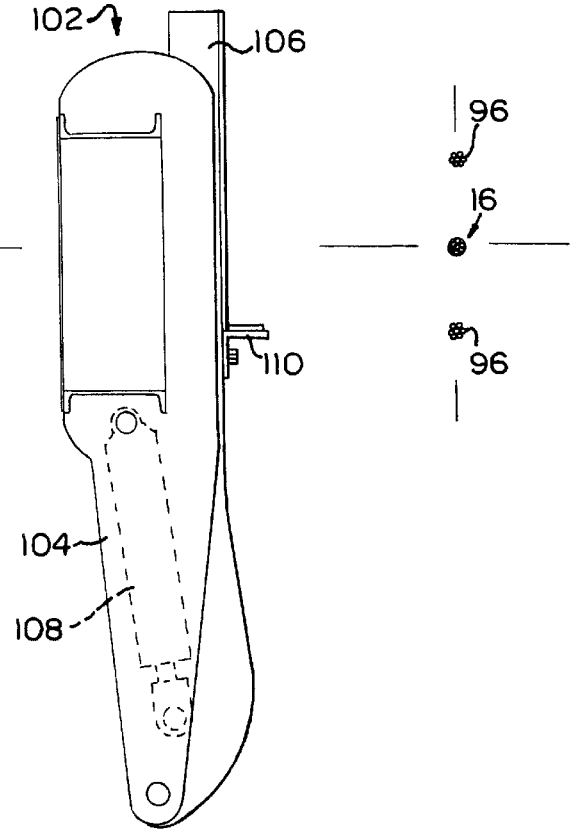
FIG. 7 is a top plan view of the retractable arm according to the invention, when retracted and in relation to the cables for the drilling string and hammer housing.
Figure 10:
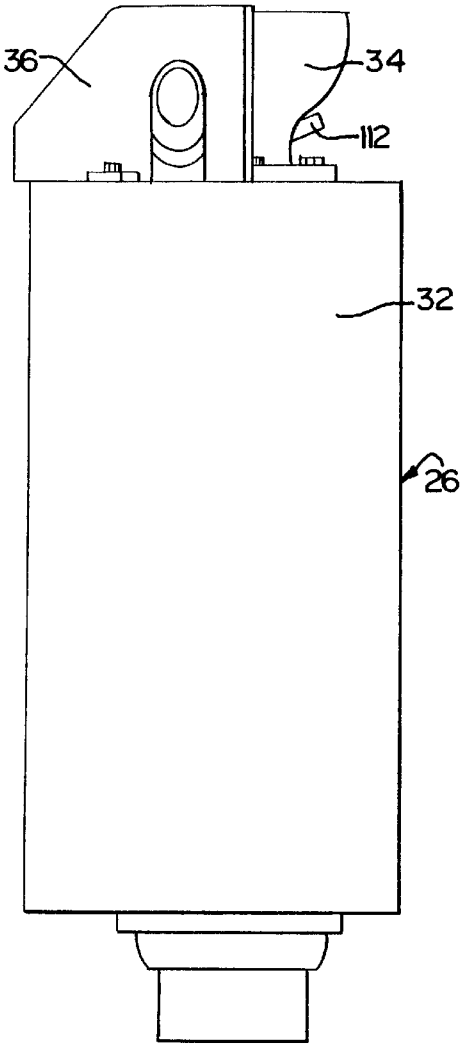
FIG. 10 is a side elevational view thereof.
Figure 9:
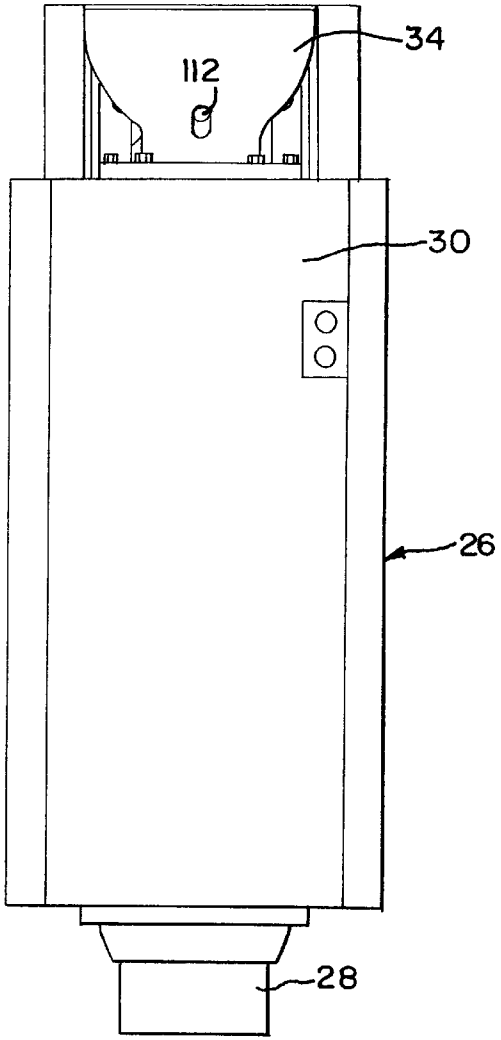
FIG. 9 is a front elevational view of the hammer housing according to the invention.
Figure 12:
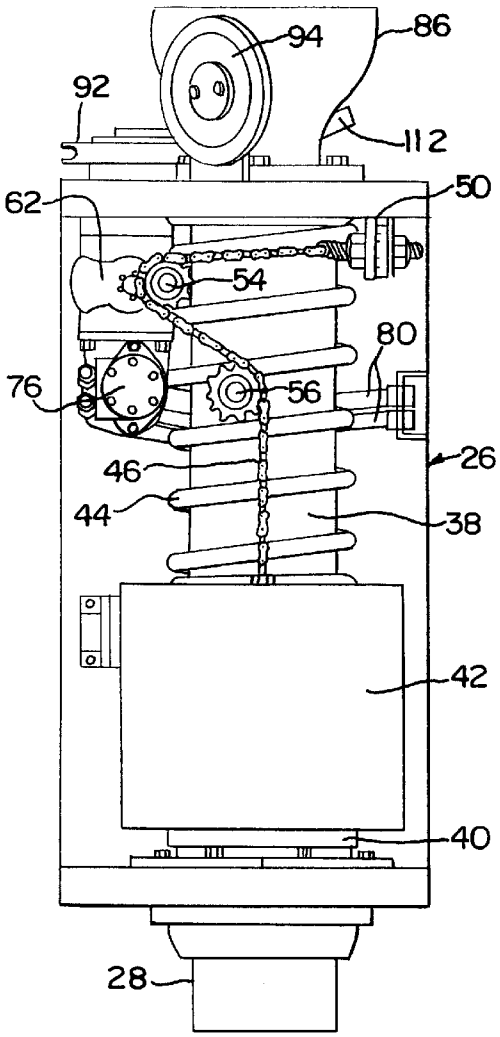
FIG. 12 is a view similar to FIG. 10 but with the housing shield again removed.
Figure 11:
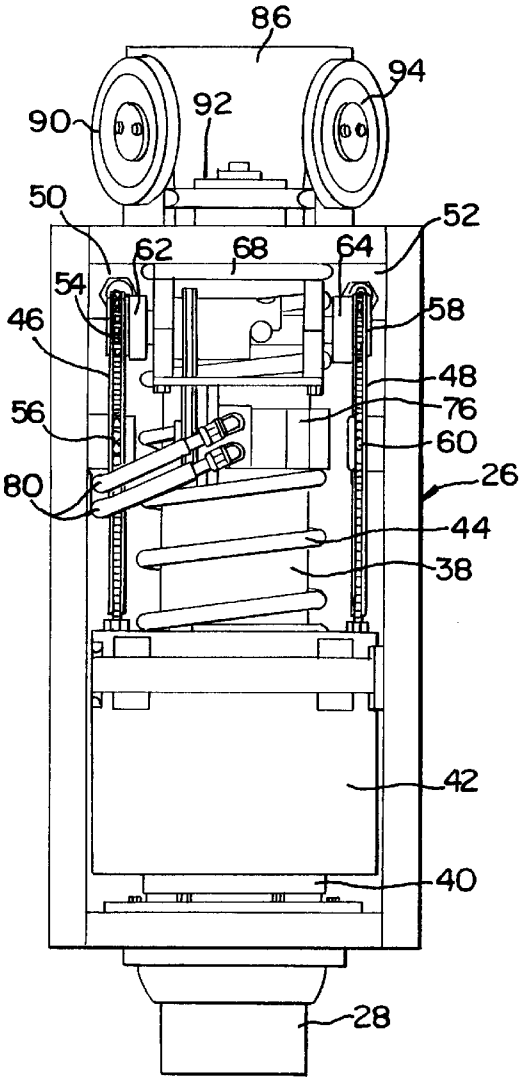
FIG. 11 is a view similar to FIG. 9, but with the housing shield removed to illustrate the internal components of the hammer housing.

As illustrated in FIG. 4, the hammer housing 26, with the drill string 16 extending there into, can be laterally shifted away from the casing pipe 20 to allow access to the casing pipe. To this end, a retractable arm 102 is fixed to the derrick 14 above the hammer housing 26. As best shown in FIGS. 7 and 8, the retractable arm is composed of a stationary member 104 and a movable member 106. The movable member 106 is pivotally secured at one end to the stationary member 104. A hydraulic cylinder 108 is connected between the members 104 and 106 to pivot the movable member 106 when desired. A stop 110 is mounted on the movable member 106 to retain the cables 96 and the cable for the drill string 16, as will be explained below.

For providing lubricating water down the casing 20 during the drilling operation, a water injection port 112 is provided at the top of the hammer housing 26. The water injection port 112 opens into the outlet 88 of the guide 86, thereby allowing injected water to pass through the central tube 38 into the casing pipe 20. The water injection port 112 is connected to an appropriate source of water (not illustrated), and water control can be by various means, such as a push button control for ease of metering drilling water.

In operation, the hammer housing 26 is first located atop a casing pipe 20 by means of operation of the drum 98 and cable 96. When the hammer housing 26 is in place, the drill string 16 is then fed through the guide 86 and through the central tube 38 into the casing pipe 20. Impact drilling using the drill string 16 then proceeds in a conventional fashion.

At the same time, however, the operator can also operate the reciprocal hammer 42 within the hammer housing 26 to assure that the bottom of the casing 20 is always close to the bottom of the hole 22, in close proximity to where drilling occurs, as illustrated in FIG. 2. Thus, unlike the prior art method illustrated in FIG. 1, excessive caving of the walls of the hole 22 does not occur and therefore excessive cuttings need not be removed during the drilling operation.

Figure 15:
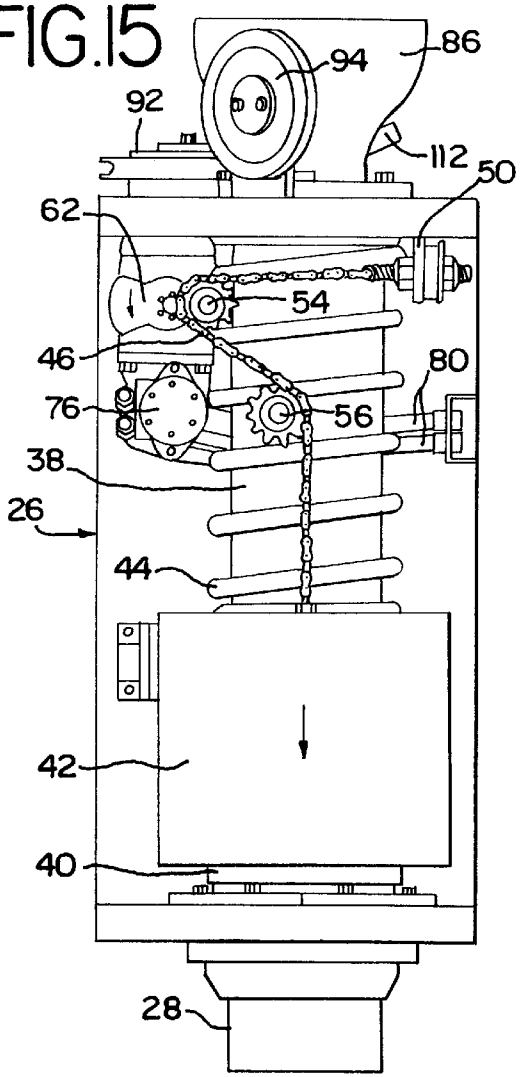
FIGS. 13, 14 and 15 are views similar to FIG. 12, and illustrating the sequence of operation of the hammer within the hammer housing.
Figure 14:
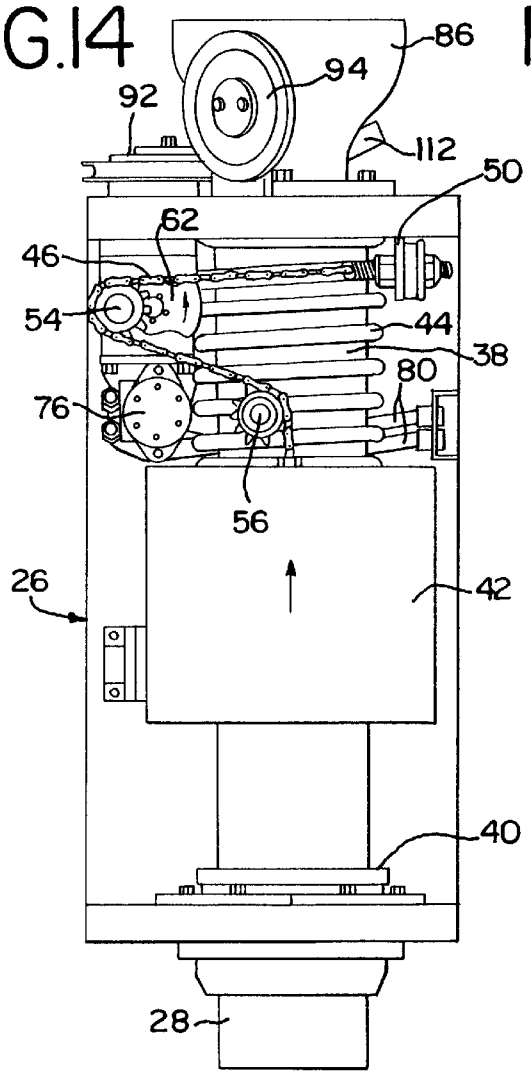
Figure 13:
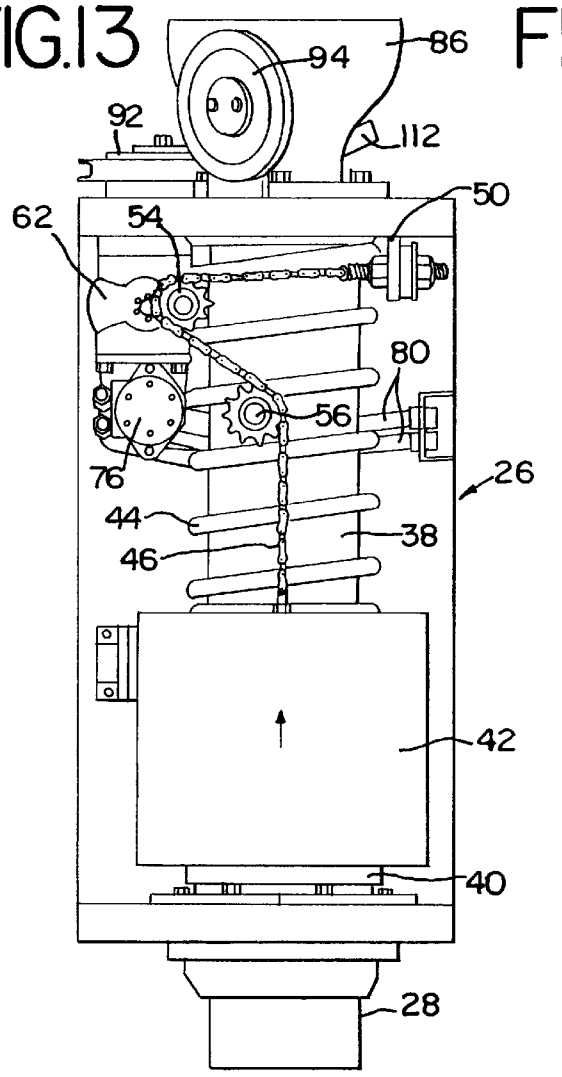

The impact operation of the reciprocal hammer 42 is best illustrated in FIGS. 13 through 15 in relation to the eccentric which is best illustrated in FIGS. 16 through 18. As the motor 76 operates, the sleeve 70 rotates about the shaft 66 until the extension 84 engages the lug 82. That occurs in the position illustrated in FIG. 13. Then, as the sleeve 70 is further rotated, because the lug 82 is seated in the extension 84, the shaft 66 also begins to rotate, rotating the arms 62 and 64 and therefore the sprockets 54 and 56. This, in turn, begins to force the two chains 46 and 48 outwardly (to the left as illustrated in FIGS. 13 through 15, thereby raising the hammer 42 against the force of the spring 44 until the hammer 42 is elevated to the position illustrated in FIG. 14. At this point, the hammer 42 beings to reverse direction as the sprockets 54 and 56 move downwardly and inwardly. Thereafter, gravity and the force of the spring 44 cause the shaft 66 to freely rotate in the counterclockwise direction in relation to FIGS. 13 through 15 so that the hammer 42 is essentially free and is forced downwardly by the force of gravity in combination with the force of the spring 44, impacting on the anvil 40 as illustrated in FIG. 15. When impact occurs, the sprockets 54 and 58, on their respective arms 62 and 64, are rotated to the orientation illustrated in FIG. 15. However, the sleeve 70, which is driven by the chain 72, is approximately 180° behind the rotation of the shaft 66, and therefore "catches up" with the extension 84 once again engaging the lug 82. This process is then repeated for so long as the motor 76 is driven, with the impact of the hammer 42 on the anvil 40 driving the casing pipe 20 into the ground. This process continues until the casing pipe 20 is driven as far as possible, and then, in a conventional fashion, a further length of casing pipe 20 is secured to the lower casing pipe 20 and is driven as the drilling operation progresses.

In order to gain access to the casing pipe 20 at any time, the drill string 18 is raised until the drill stem 18 is within the hammer housing 26, protruding slightly if at all from the collar 28. Then, the drum 98 is operated to raise the hammer housing 26 until the collar 28 is free above the top of the casing pipe 20. Then, referring to FIGS. 3, 4, 7 and 8, the hydraulic cylinder 108 of the retractable arm 102 is activated, capturing the cables 96 and the cable of the drill string 16 against the stop 110 as illustrated in FIG. 8, and shifting the hammer housing 26 and the drill string 16 laterally, as illustrated in FIG. 4, so that the casing pipe 20 can easily be accessed.

The invention provides many advantages over prior art cable tool drilling. First, the invention allows simultaneous sinking of the casing pipe 20 as the drilling operation continues. Second, because the bottom of the casing pipe 20 extends close to the bottom of the hole 22 being drilled, the amount of cuttings to be cleaned from the hole is substantially reduced, thereby greatly increasing the efficiency of the drilling operation. Third, by use of the retractable arm 102, it is easy to move the drill string 16 and the hammer housing 20 to one side to easily gain access to the top of the casing pipe 20. Fourth, by the orientation of the cable 96 through the cable pulleys 90 through 94, not only is the cable 96 free of the central area through which the drill string passes, but also the hammer housing 26 can be well balanced for lifting that is essentially axial in direction. Fifth, the hammer 42, located within the hammer housing 26, strikes only on the anvil 40 at the top of the casing pipe 20. Thus, no parts of the hammering apparatus are moving on the inside or outside of the casing pipe 20, eliminating the possibility of damage or binding. Sixth, water injection is very simple through the injection port 112, eliminating the need for an operator to possibly climb 20 feet or more up the derrick 14 for water injection. Various other advantages will be apparent to one skilled in the art.

Various changes can be made to the invention without departing from the spirit thereof or scope of the following claims.

What is claimed is:

1. A casing hammer assembly for a cable tool drilling apparatus, comprising a. an upstanding hammer housing, b. means for mounting said hammer housing on a casing pipe, c. a central aperture through said hammer housing being formed to permit drilling apparatus to pass freely through said hammer housing into and out of the casing pipe upon which said hammer housing is mounted, d. a guide proximate and at least partially surrounding said central aperture, e. an impact anvil surrounding said guide and secured to said hammer housing, f. a reciprocal hammer mounted on said guide and positioned to strike said impact anvil, and g. means for actuating said hammer, comprising i. an eccentric connected for periodically raising and releasing said hammer, said eccentric comprising a rotatable shaft having an offset hammer operator at one end and a sleeve freely mounted on said shaft for revolving relative to said shaft, said shaft including a radially protruding lug and said sleeve including an extension shaped to engage said lug to rotate said shaft in unison with said sleeve when said extension engages said lug, and ii. a motor for driving said eccentric.

2. A casing hammer assembly according to claim 1 including means for laterally shifting said hammer housing.

3. A casing hammer assembly according to claim 2 in which said means for laterally shifting comprises a retractable arm fixed above said hammer housing.

4. A casing hammer assembly according to claim 3 in which said retractable arm comprises a first stationary member and a second movable member secured to said stationary member.

5. A casing hammer assembly according to claim 4 in which said movable member is pivotally secured at one end to said stationary member.

6. A casing hammer assembly according to claim 4 including a hydraulic cylinder connected to said members for actuating said movable member.

7. A casing hammer assembly according to claim 1 in which said guide comprises a central tube.

8. A casing hammer assembly according to claim 1 including means biasing said hammer toward said impact anvil.

9. A casing hammer assembly according to claim 8 in which said biasing means comprises at least one compression spring bearing between said hammer housing and said hammer.

10. A casing hammer assembly according to claim 1 in which said motor is drivingly connected to said sleeve for rotating said sleeve.

11. A casing hammer assembly according to claim 10 in which said motor is connected to said sleeve by an endless chain drive.

12. A casing hammer assembly according to claim 11 including a flexible support in said hammer housing for suspending said hammer above said impact anvil, said hammer operator engaging said flexible support.

13. A casing hammer assembly according to claim 12 in which said flexible support comprises a chain secured between said hammer housing and said hammer, and said hammer operator comprises a gear wheel mounted on an arm extending radially from said one end of said rotatable shaft.

14. A casing hammer assembly according to claim 1 in which said motor is a hydraulic motor.

15. A casing hammer assembly according to claim 1 in which said mounting means comprises a collar extending from said impact anvil.

16. A casing hammer assembly according to claim 1 including means for positioning and holding said hammer housing above a casing pipe.

17. A casing hammer assembly according to claim 16 in which said means for positioning and holding comprises cable pulleys mounted on said hammer housing adjacent said central aperture, and a hoist cable engaged in said pulleys.

18. A casing hammer assembly according to claim 16 including a water injection port on said hammer housing.

19. A cable tool drilling apparatus, comprising a. a portable derrick, b. a drilling string extending from said derrick, c. an upstanding hammer housing, d. means extending from said derrick for mounting said hammer housing on a casing pipe, e. a central aperture through said hammer housing being formed to permit said drilling string to pass freely through said hammer housing into and out of the casing pipe upon which said hammer housing is mounted, f. a guide tube at least partially surrounding said central aperture, g. an impact anvil surrounding said guide tube and secured to said hammer housing, h. a reciprocal hammer mounted on said guide tube and positioned to strike said impact anvil, i. means for actuating said hammer, comprising i. an eccentric connected for periodically raising and releasing said hammer, said eccentric comprising a rotatable shaft having an offset hammer operator at one end and a sleeve freely mounted on said shaft for revolving relative to said shaft, said shaft including a radially protruding lug and said sleeve including an extension shaped to engage said lug to rotate said shaft in unison with said sleeve when said extension engages said lug, ii. a motor for driving said eccentric, and j. a retractable arm mounted on said derrick for laterally shifting said hammer housing.

* * * * *